US005313866A

United States Patent [19]

Smith

[11] Patent Number: 5,313,866

[45] Date of Patent: May 24, 1994

[54] GUITAR STAND

[75] Inventor: Kevin M. Smith, Mound, Minn.

[73] Assignee: Guitar & Light Fabrication, Mound, Minn.

[21] Appl. No.: 968,983

[22] Filed: Oct. 30, 1992

[51] Int. Cl.[5] ..... G10D 3/00

[52] U.S. Cl. ..... 84/327; 248/121; 248/231.4

[58] Field of Search ..... 248/231.4, 231.7, 312, 248/121; 84/327, 453

[56] References Cited

U.S. PATENT DOCUMENTS

| | | | |
|---|---|---|---|
| 3,765,633 | 10/1973 | Caudhill | 248/231.4 |
| 3,958,786 | 5/1976 | Mann | 84/327 X |
| 4,546,688 | 10/1985 | Cuccio | 84/327 |
| 4,991,809 | 2/1991 | Harkey | 248/231.4 |
| 5,031,868 | 7/1991 | Thomas, II | 84/327 X |
| 5,149,905 | 9/1992 | Count | 84/327 X |

*Primary Examiner*—Michael L. Gellner
*Assistant Examiner*—P. Stanzione
*Attorney, Agent, or Firm*—Patterson & Keough

[57] ABSTRACT

A guitar stand specially adapted to attach to existing stage amplification equipment thereby providing a stable support for an acoustic or electric guitar while maximizing the stage space available to the performer. The guitar stand includes a yoke, a support arm and a base, and a clamping mechanism. In operation, the guitar stand is detachably clamped to amplification equipment and supports the guitar above the floor. The unique structure of the stand balances the weight of the guitar against the weight of the equipment for stability.

7 Claims, 3 Drawing Sheets

GUITAR STAND

TECHNICAL FIELD

The present invention deals broadly with the field of musical instrument stands. More specifically, it relates to a stand for use with acoustic and electric guitars.

BACKGROUND OF THE INVENTION

Guitar stands and other musical supports have been used for many years. Typically, guitar stands rest on the floor and support the guitar from the base and/or the tuning head of the guitar. Floor guitar stands rely on the stability of three legs in a tripod to keep the guitar in a safe, upright position. However, traditional guitar stands tip over quite easily, risking damage to the guitars. In addition, the stage floor space available to the performer is reduced by the size of the floor area encompassed by the tripod legs.

An invention that would provide a stable guitar stand that maximizes the performer's usable stage space would be greatly appreciated.

Another objective of the present invention is to provide a guitar stand which is strong, lightweight and easily installed or removed.

A further objective of the present invention is to provide a guitar stand which is adjustable for varying shapes of tuning heads of guitars.

SUMMARY OF THE INVENTION

The present invention is a guitar stand which attaches to existing stage amplification equipment and provides a stable support for an acoustic or electric guitar while maximizing the stage space available to the performer. The guitar stand includes a yoke, a support arm and a base, and a clamping mechanism. In operation, the guitar stand is clamped to an amplifier. The guitar head is placed in the yoke. The height of the support arm and amplifier support the guitar above the stage floor. The unique structure of the support arm and base balances the weight of the guitar against the weight of the amplifier for stability. The clamping mechanism uses structure tension and the force of clamp screws to secure the stand to the amplification equipment.

DETAILED DESCRIPTION OF THE INVENTION

Figure 2:
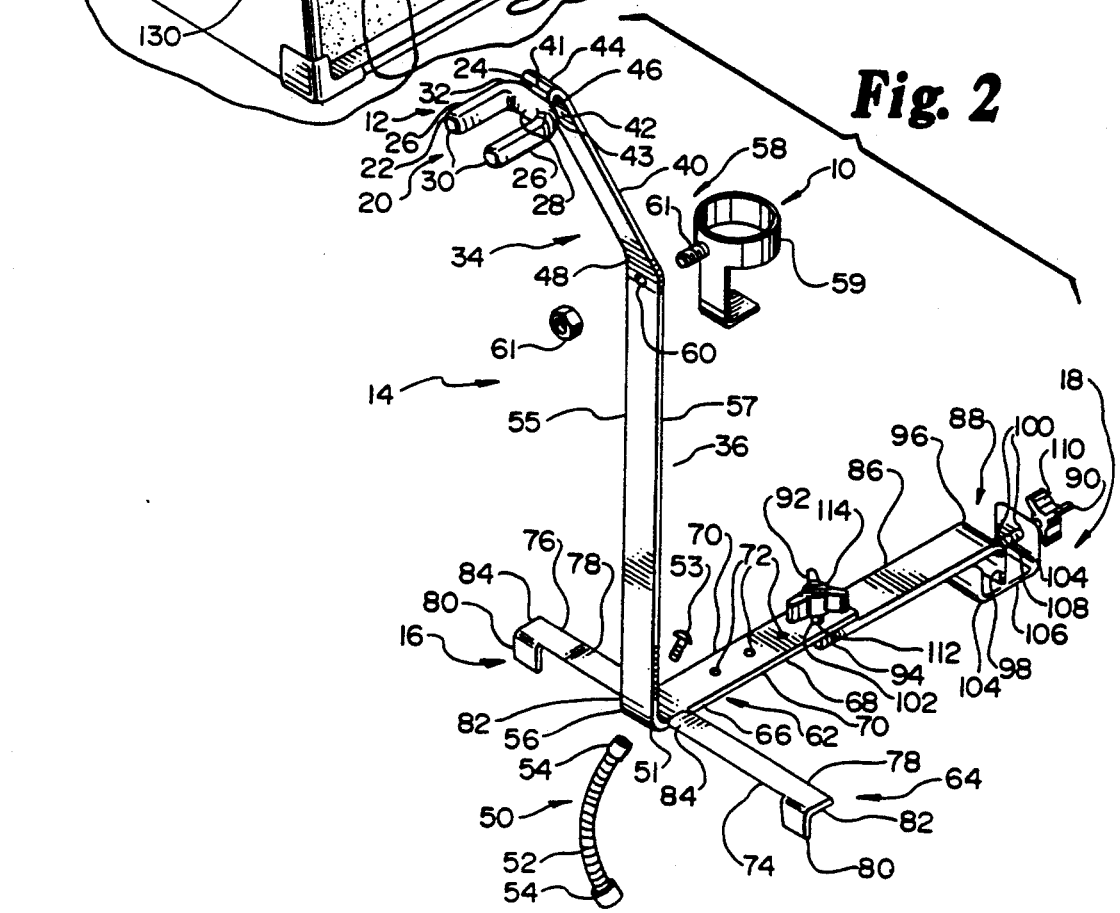
FIG. 2 is a perspective view of a guitar stand in accordance with the present invention.

Referring now to the drawings, wherein like reference numerals denote like elements throughout the several views, FIG. 2 illustrates a guitar stand 10 in accordance with the present invention. The guitar stand 10 includes a yoke 12, support arm 14, support base 16 and clamping mechanism 18.

In the preferred embodiment, the yoke 12 includes a generally U-shaped member 20, cushioning sleeve 22 and structure defining an attachment bore 24. The U-shaped member 20 includes opposed side arms 26 and connecting bar 28. Each side arm 26 presents a front face 30. The connecting bar 28 includes an outer face 32. The U-shaped member is formed of a generally cylindrical metal tube with metal seals placed across each front face 30 of each side arm 26. The cushioning sleeve 22 encases at least a portion of each side arm 26 and the connecting bar 28. The attachment bore 24 is a threaded bore located on the outer face 32 of the connecting bar 32 and extending into the connecting bar 28.

The support arm 14 includes an angled upper portion 34 and an upright lower portion 36. The upper portion 34 includes a front plate 38, a back plate 40 and a yoke screw 42. The front plate 38 is downwardly, outwardly angled, carries a front face 41, a rear face 43, an upper margin 44 and includes structure defining a threaded bore 46. The threaded bore 46 extends from the front face 41 to the rear face 43 of the front plate 38 and is of sufficient diameter to be tightly coupled to yoke screw 42.

The back plate 40 is joined to the front plate 38 along the upper margin 44 of the front plate 38. In the preferred embodiment, the back plate 40 is joined to the front plate 38 at 70°-90° angle. The back plate 40 is downwardly, outwardly angled and carries a lower margin 48.

The upright lower portion 36 of the support arm 14 is joined to the back plate 40 along the lower margin 48. In the preferred embodiment, the upright lower portion 36 of the support arm 14 is joined to the back plate 40 at a 45°-60° angle. The lower portion 36 includes a front face 55, a rear face 57 and a bottom margin 56.

Figure 4:
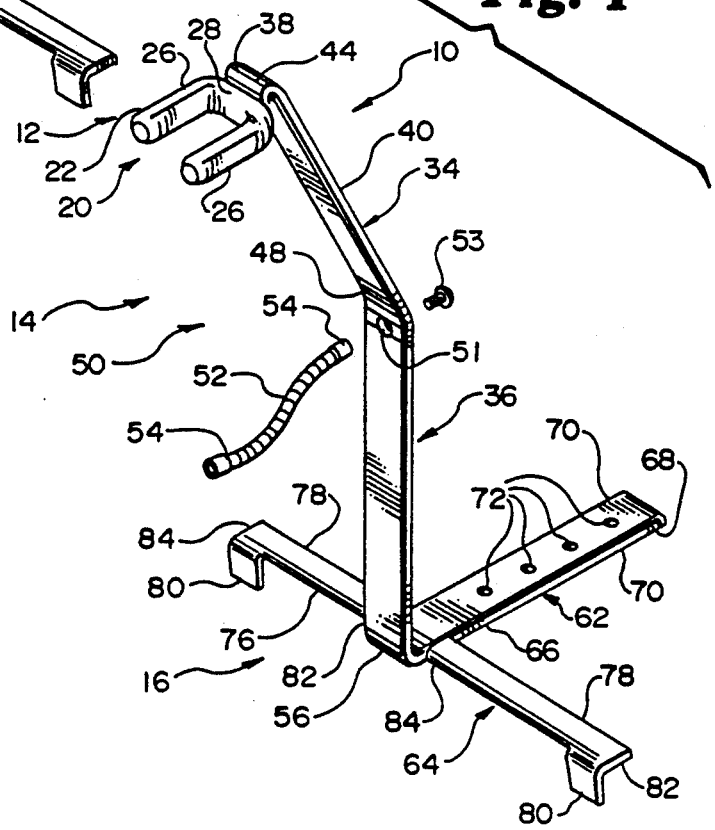
FIG. 4 is a perspective view of another alternate embodiment of the present invention.

Referring to FIG. 2, in the preferred embodiment, the lower portion 36 of the support arm 14 also includes a microphone holder 50 proximate to the bottom margin 56. The microphone holder 50 includes structure defining a microphone bore 51 and gooseneck tubing 52. The microphone bore 51 extends from the front face 55 to the rear face 57 of the lower portion 36. The gooseneck tubing 52 includes opposed externally threaded ends 54. The microphone bore 51 is of sufficient diameter to be tightly coupled to a threaded end 54 of the gooseneck tubing 52. Those skilled in the art will understand that alternate forms of microphone holders 50 are possible. For example, the ends 54 of the gooseneck tubing 52 may be threaded internally and be attached to the guitar stand 10 by tightly coupling a screw 53 in the microphone bore 51 with the gooseneck tubing 52. Referring to FIG. 4, in an alternate embodiment, the microphone holder 50 is proximate to the lower margin 48 of the back plate 40.

An alternate embodiment (not shown) of the present invention as shown in FIG. 4, adaptable to be mounted on a vertical surface, includes a yoke 12 and support arm 14 as shown in FIG. 4 with the support arm 14 including structure defining a plurality of holes for operably attaching the alternative embodiment to a vertical surface such as a wall.

In the preferred embodiment, the lower portion 36 also includes a beverage holder 58. The beverage holder 58 includes a holder member 59, a beverage holder bore 60 and a threaded holder screw and nut assembly 61. In this alternate embodiment, the beverage holder bore 60 is a threaded bore extending from the front face 55 to the rear face 57 of the lower portion 36 and is of sufficient diameter to be tightly coupled to the holder screw and nut assembly 61. The holder member 59 is attached to the lower portion 36 with the holder screw and nut assembly 61 in the beverage holder bore 60.

The support base 16 is joined to the lower portion 36 of the support arm 14 along the bottom margin 56 of the lower portion 36 at a generally perpendicular angle. The support base 16 generally includes a rear bar 62 and front brace 64. The rear bar 62 presents a front portion 66, a rear portion 68 and opposed side margins 70. In the preferred embodiment, the rear bar 62 also includes a plurality of base bores 72. The rear bar 62 is welded to the front brace 64 at the front portion 66 of the rear bar 62 at a generally perpendicular angle. The base bores 72 are positioned in a line extending from the front portion 66 through the rear portion 68 of the rear bar 62 generally parallel to and equidistant from the side margins 70.

The front brace 64 includes a right brace leg 74 and a left brace leg 76. It will be understood that the designations of right and left, front and rear, are arbitrary, depending on the orientation of the viewer and are provided herein for ease of reference from the viewpoint of a user in front of the stand 10. Each brace leg 74, 76 includes an extended member 78 and a toe 80. Each extended member 78 presents a right end 82 and a left end 84. Each toe 80 is joined to each extended member 78 at a generally perpendicular angle. The brace leg 74 is attached to the rear bar 62 at the left end 84 of the brace leg 74 and the toe 80 is attached to the brace leg 74 at the right end 82 of the brace leg 74. Mirroring the brace leg 74, the brace leg 76 is attached to the rear bar 62 at the right end 82 of the brace leg 76 and the toe 80 is attached to the brace leg 76 at the left end 84 of the brace leg 76.

In the preferred embodiment, the support arm 14 and rear bar 62 of the support base 16 are a unitary piece formed by bending a metal strip or metal casting. It will be understood by those skilled in the art that the support arm 14, rear bar 62 and front brace 64 could also be formed as a unitary piece by casting.

Figure 6:
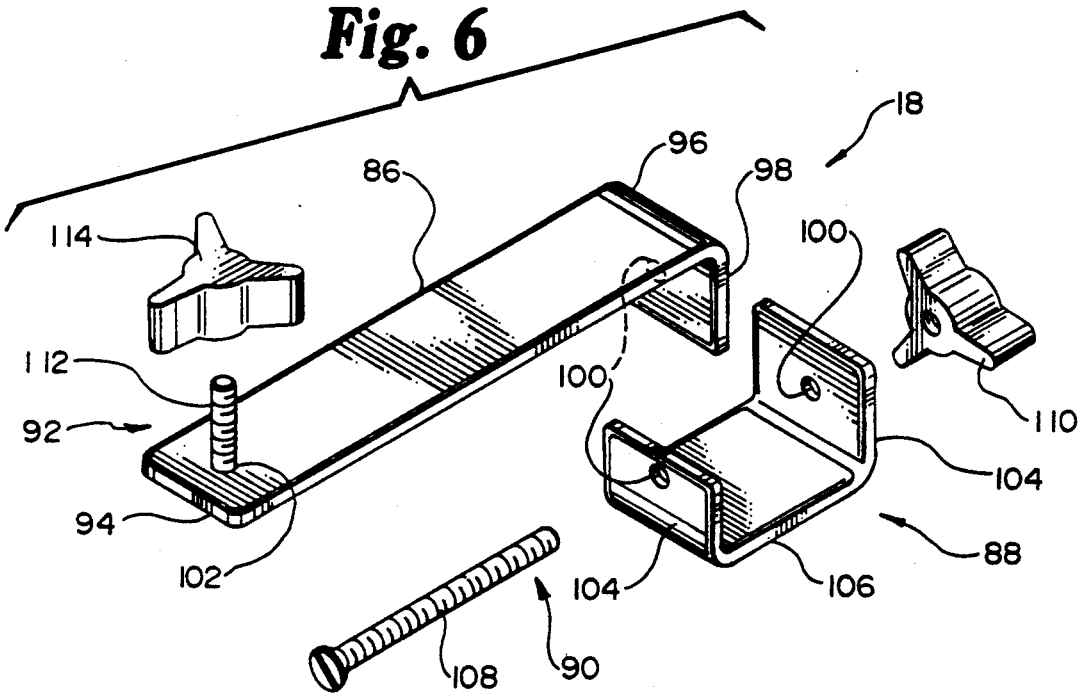
FIG. 6 is a perspective view of the clamping mechanism in accordance with the preferred embodiment of the present invention.

Referring to FIGS. 2 and 6, in the preferred embodiment, the clamping mechanism 18 broadly includes a rear brace 86, tension member 88, tension screw 90 and adjusting screw 92. The rear brace 86 presents a front end 94 and a back end 96. The back end 96 includes a right angle plane 98 and structure defining a tension bore 100. The front end 94 includes structure defining a threaded adjusting screw bore 102. The tension member 88 includes opposed side plates 104 and bottom plate 106. Each opposed side plate 104 includes structure defining a tension bore 100. The tension bores 100 are threaded and are positioned in the right angle plane 98 and opposed side plates 104 whereby the tension bores 100 are aligned to receive the tension screw 90. The tension screw 90 includes a threaded shaft 108 and a nut 110. The adjusting screw 92 includes a threaded shaft 112 and a nut 114. The shaft 112 is tightly coupled to the rear brace 86 by placement within the adjusting screw bore 102.

Figure 3:
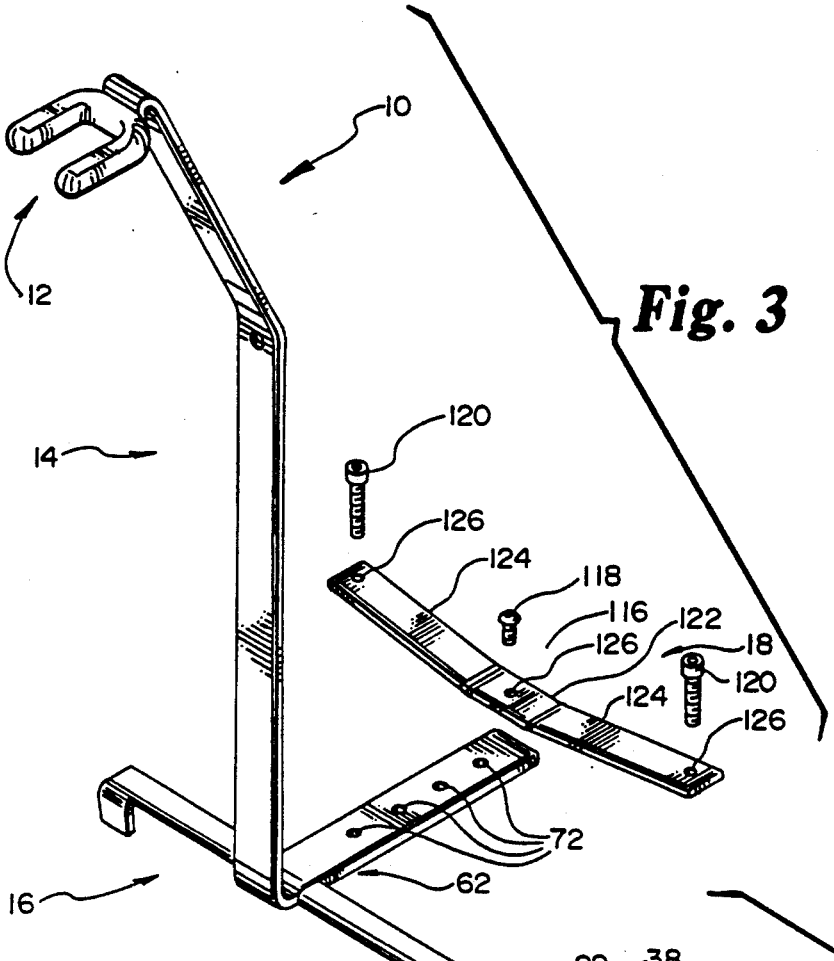
FIG. 3 is a perspective view of an alternate embodiment of the present invention.

Referring to FIG. 3, in an alternate embodiment, the clamping mechanism 18 includes a strip brace 116, a connecting screw 118 and a plurality of balancing screws 120. The strip brace 116 presents a center portion 122 and includes opposed tension strips 124 and structure defining a plurality of screw holes 126. The opposed tension strips 124 angle upward and extend outward from the center portion 122. The center portion includes a screw hole 126 for receiving connecting screw 118. Each of the tension strips 124 include a screw hole 126 for receiving a screw 120. In this embodiment, the rear bar 62 is lengthened and a single base bore 72 is present whereby the connecting screw 118 attaches the strip brace 116 to the rear bar 62 by being tightly screwed into the single base bore 72. The balancing screws 120 are coupled to the screw holes 126 of the opposed tension strips 124 and extending above the strips 124.

Figure 1:
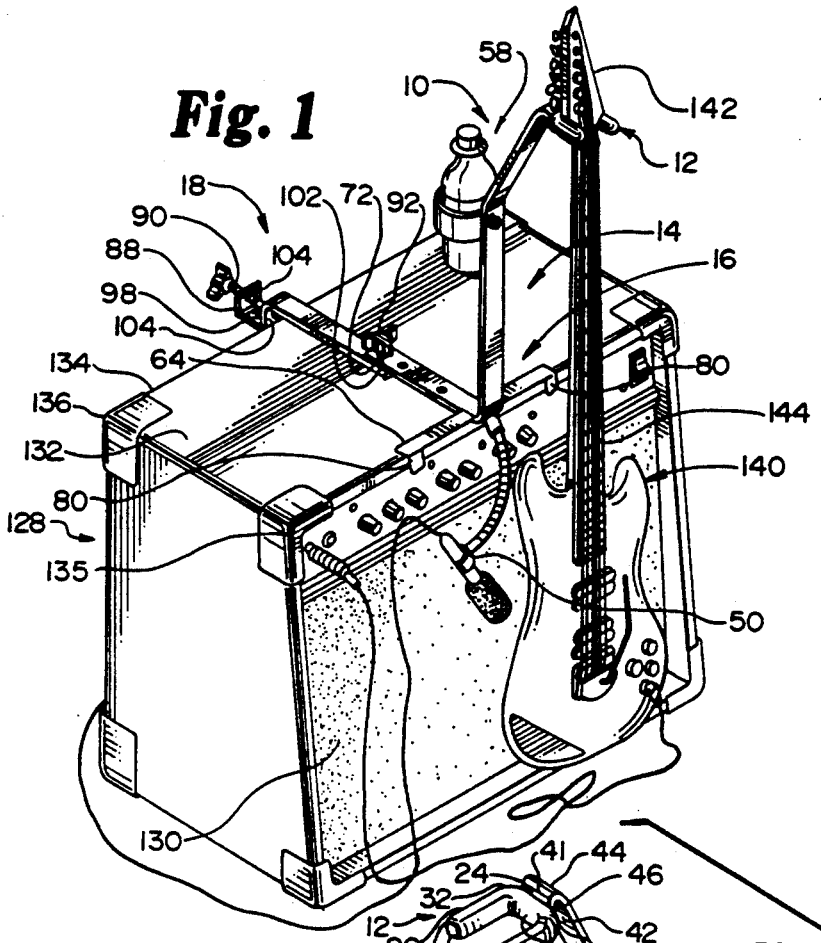
FIG. 1 is a perspective view of the present invention installed on amplification equipment.

In operation, referring to FIG. 1, in the preferred embodiment, the guitar stand 10 is attached to an amplifier 128. The amplifier 128 is a box presenting a front surface 130, a top surface 132 and a back surface 134. The top surface 132 carries a front margin 135 and back edge 136 and presents a width extending between the front margin 135 and the back edge 136. In the preferred embodiment, the guitar stand 10 is attached to the amplifier 128 by placing the front brace 64 along the front margin 135 and adjusting the clamping mechanism 18 whereby the toes 80 of the front brace 64 grip the front surface 130 of the amplifier 128 and the right angle plane 98 of the rear brace is biased to hold a side plate 104 of the tension member against the back surface 134 of the amplifier 128. The guitar stand 10 attaches to the amplifier 128 whereby the amplifier 128 provides a stable base of support.

The clamping mechanism includes both coarse and fine adjustment mechanisms. The coarse adjustment is provided by the alignment of the adjusting screw bore 102 with a base bore 72 whereby the adjusting screw 92 tightly couples the support base 16 and the clamping mechanism 18. The fine adjustment is provided by the pressure exerted by the tension member 88 on the rear brace 86 as the tension screw 90 is turned to tightly couple a side plate 104 of the tension member 88 against the right angle plane 98 of the rear brace 86. The use of screws to provide the coarse and fine adjustments allow for a securely mounted yet easily installed and removable guitar stand.

Figure 5:
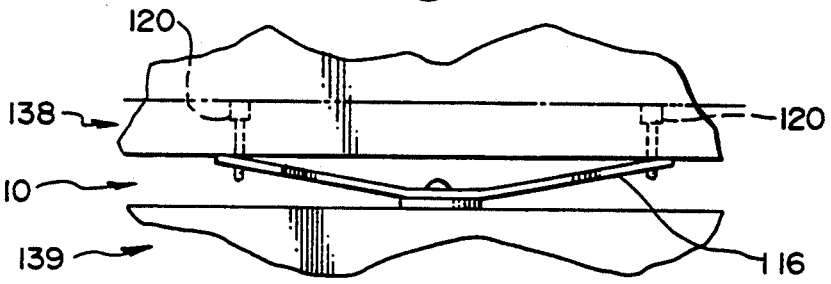
FIG. 5 is an elevational view of the alternate embodiment of present invention as depicted in FIG. 3 installed on amplification equipment.

Referring to FIG. 5, in an alternate embodiment, the guitar stand 10 is placed between an upper and a lower box-shaped piece of amplification equipment 138, 139. The weight of the upper piece 138 on the strip brace 116 provides the stability for the guitar stand 10. The balancing screws 120 urge the upper piece 138 into constant contact with the strip brace 116 whereby any shifting of the upper piece 138, lower piece 139 or the guitar stand 10 is minimized. Placement of the alternate embodiment of the guitar stand 10 between an upper and lower piece 138, 139 of amplification equipment utilizes the weight of the amplification equipment and the structure of the brace to provide a secure, yet easily installed and removable mount for the guitar stand 10.

Referring to FIG. 1, once the guitar stand 10 is secured to the amplification equipment, a guitar 140 may be placed in the guitar stand 10. A guitar 140 broadly includes a tuning head 142 operably coupled to a guitar body 144. The guitar stand 10 supports guitar 140 by resting the tuning head 142 of the guitar 140 in the yoke 12. The yoke 12 can be adjusted to accomodate guitars 140 with varying tuning heads 142 by pivoting the yoke 12 on the yoke screw 42. Alternate embodiments of the guitar stand 10 vary the height of the support arm 14 whereby guitars 140 of varying size and shape can be supported above the floor by the guitar stand 10. The height of the support arm 14 combined with the height of the amplifier 128 suspend the guitar 140 above the floor thereby greatly reducing the amount of floor space required to store a guitar 140 on a stage. In addition, the guitar stand 10 uses the weight of the amplifier 128 to counter the weight of a guitar placed in the stand and increase stability.

The use of lightweight metals and the unitary design of the guitar stand 10 provide strength and enhance the stability of the guitar stand 10 to support the guitar 140 in a secure upright position.

In the preferred embodiment, the presence of the beverage holder 58 and the gooseneck microphone holder 50 enhance the comfort of a performer using the guitar stand 10.

Numerous characteristics and advantages of the invention have been set forth in the foregoing description. It will be understood, of course, that this disclosure is, in many respects, only illustrative. Changes can be made in details, particularly in the matters of shape, size and arrangement of parts without exceeding the scope of the invention. The invention scope is defined by the language by which the appendant claims are expressed.

I claim:

1. A stand for a guitar, said guitar including a guitar neck and a guitar base, said guitar neck extending above said guitar base and including a tuning head, whereby said guitar is supported alongside stage amplification equipment, comprising:

yoke means for holding said tuning head;

support means operably coupled to said yoke means for balancing said guitar against said stage amplification equipment, said support means including a generally upright arm, a base and a front brace, said upright arm including an upper and lower portion, said upper portion including a front plate and back plate, said front plate operably joined to said back plate at an angle of less than 90°; and clamp means operably, detachably, adjustably coupled to said support means for adjustably attaching said support means to said stage amplification equipment.

2. The support means of claim 1 wherein said back plate of said upper portion is operably joined to said lower portion at an angle of not less than 45° and not more than 60°.

3. The support means of claim 2 wherein said upright arm is operably joined to said base at a generally perpendicular angle.

4. The stand of claim 3 further including beverage holder means for holding a cup or beverage can.

5. The stand of claim 3 further including microphone holder means for supporting and positioning a microphone near said guitar.

6. A stand for a guitar, said guitar including a guitar neck and a guitar base, said guitar neck extending above said guitar base and including a tuning head, whereby said guitar is supported alongside stage amplification equipment, comprising:

yoke means for holding said tuning head;

support means operably coupled to said yoke means for balancing said guitar against said stage amplification equipment, said support means including a generally upright arm, a base and a front brace, said upright arm operably joined to said base at a generally perpendicular angle, said upright arm further including an upper and lower portion, said upper portion including a front plate and back plate, said front plate operably joined to said back plate at an angle of less than 90°, said back plate of said upper portion operably joined to said lower portion at an angle of not less than 45° and not more than 60°; and clamp means operably, detachably, adjustably coupled to said support means for adjustably attaching said support means to said stage amplification equipment; said clamp means including a rear brace, tension member, and tension screw, said rear brace presenting a front end and a back end, said back end including a right angle plane and structure defining a tension bore, said tension member including opposed side plates, each opposed side plate including structure defining a tension bore, said tension bores threaded and aligned to receive said tension screw whereby the front end of the rear brace is operably attached to said support means and said right angle plane is urged against said side plate of said tension member and said side plate is urged against said amplification equipment when said tension screw is received by said tension bores.

7. A stand for a guitar, said guitar including a guitar neck and a guitar base, said guitar neck extending above said guitar base and including a tuning head, whereby said guitar is supported alongside stage amplification equipment, comprising:

yoke means for holding said tuning head;

support means operably coupled to said yoke means for balancing said guitar against said stage amplification equipment, said support means including a generally upright arm, a base and a front brace, said upright arm operably joined to said base at a generally perpendicular angle, said upright arm further including an upper and lower portion, said upper portion including a front plate and back plate, said front plate operably joined to said back plate at an angle of less than 90°, said back plate of said upper portion operably joined to said lower portion at an angle of not less than 45° and not more than 60°; and clamp means operably, detachably, adjustably coupled to said support means for adjustably attaching said support means to said stage amplification equipment; said clamp means including a strip brace and a plurality of balancing screws, said strip brace presenting a center portion and includes opposed tension strips, said tension strips angling upward and extending outward from said center portion and including a plurality of posts, said posts operably attached to said tension strips and extending upward generally perpendicular to said tension strips whereby said posts urge said amplification equipment into alignment on said tension strips.

* * * * *